US008654051B2

(12) United States Patent
Lee

(10) Patent No.: US 8,654,051 B2
(45) Date of Patent: Feb. 18, 2014

(54) LIQUID CRYSTAL DISPLAY DEVICE AND METHOD OF DRIVING THE SAME

(75) Inventor: Byoung-Gwan Lee, Hwaseong-si (KR)

(73) Assignee: LG Display Co., Ltd., Seoul (KR)

( * ) Notice: Subject to any disclaimer, the term of this patent is extended or adjusted under 35 U.S.C. 154(b) by 528 days.

(21) Appl. No.: 12/591,836

(22) Filed: Dec. 2, 2009

(65) Prior Publication Data

US 2011/0084980 A1 Apr. 14, 2011

(30) Foreign Application Priority Data

Oct. 8, 2009 (KR) ..... 10-2009-0095559

(51) Int. Cl.
*G09G 3/36* (2006.01)

(52) U.S. Cl.
USPC ..... 345/89; 345/101; 345/102; 345/214; 349/72

(58) Field of Classification Search
USPC ..... 345/88, 101–102, 690, 204–215; 349/72
See application file for complete search history.

(56) References Cited

U.S. PATENT DOCUMENTS

| | | | | |
|---|---|---|---|---|
| 4,738,514 | A * | 4/1988 | Stewart | 345/101 |
| 5,428,265 | A * | 6/1995 | Booth et al. | 315/158 |
| 5,489,918 | A * | 2/1996 | Mosier | 345/89 |
| 6,198,234 | B1 * | 3/2001 | Henry | 315/291 |
| 6,445,143 | B1 * | 9/2002 | Min | 315/307 |
| 6,713,744 | B1 * | 3/2004 | Kubo et al. | 250/205 |
| 7,330,002 | B2 * | 2/2008 | Joung, Il | 315/309 |
| 7,592,995 | B2 * | 9/2009 | Sugino et al. | 345/101 |
| 7,903,081 | B2 * | 3/2011 | Jang et al. | 345/102 |
| 7,924,254 | B2 * | 4/2011 | Hsu et al. | 345/89 |
| 7,990,360 | B2 * | 8/2011 | Song et al. | 345/102 |
| 8,139,018 | B2 * | 3/2012 | Kim | 345/101 |
| 2004/0201564 | A1 * | 10/2004 | Sugino et al. | 345/101 |
| 2005/0041007 | A1 * | 2/2005 | Iijima | 345/101 |
| 2007/0216616 | A1 * | 9/2007 | Stessen et al. | 345/84 |
| 2007/0247405 | A1 * | 10/2007 | Chan | 345/88 |
| 2008/0001911 | A1 * | 1/2008 | Kim | 345/102 |
| 2008/0055230 | A1 * | 3/2008 | Jang et al. | 345/102 |
| 2008/0068318 | A1 * | 3/2008 | Kerwin | 345/89 |
| 2008/0258637 | A1 * | 10/2008 | Leung | 315/185 R |
| 2009/0021669 | A1 * | 1/2009 | Lee et al. | 349/72 |
| 2010/0156777 | A1 * | 6/2010 | Kang et al. | 345/102 |

FOREIGN PATENT DOCUMENTS

| | | |
|---|---|---|
| KR | 10-2006-0104356 | 10/2006 |
| KR | 10-2006-0129896 | 12/2006 |
| KR | 10-2007-0071722 | 7/2007 |

* cited by examiner

*Primary Examiner* — Vijay Shankar
*Assistant Examiner* — Sanjiv D Patel
(74) *Attorney, Agent, or Firm* — McKenna Long & Aldridge, LLP

(57) ABSTRACT

A liquid crystal display device includes: a liquid crystal panel; a temperature sensing means configured to measure a real-time temperature of the liquid crystal panel; a backlight unit configured to supply a light to the liquid crystal panel; a control unit configured to convert an image signal into an RGB signal and to convert a first dimming signal to a second dimming signal according to the real-time temperature; and an inverter unit configured to adjust the backlight unit using the second dimming signal.

23 Claims, 8 Drawing Sheets

LIQUID CRYSTAL DISPLAY DEVICE AND METHOD OF DRIVING THE SAME

This application claims the benefit of Korean Patent Application No. 10-2009-0095559 filed on Oct. 8, 2009, which is hereby incorporated by reference in its entirety for all purposes as if fully set forth herein.

BACKGROUND OF THE INVENTION

1. Field of the Invention

The present application relates to a liquid crystal display device, and more particularly, to a liquid crystal display device and a method of driving the liquid crystal display device where a time uniformity of a moving picture response time is improved by reducing an optimization time period for reaching a critical temperature.

2. Discussion of the Related Art

Liquid crystal display (LCD) devices having thin profiles, light weight, and low power consumption have been used in notebook computers, office automation devices, audio/video devices, and the like. Among the various types of LCD devices, active matrix LCD (AM-LCD) devices that employ switching elements and pixel electrodes arranged in a matrix structure are the subject of significant research and development because of their high resolution and superior suitability for displaying moving images. Thin film transistor LCD (TFT-LCD) devices use thin film transistors (TFTs) as the switching elements.

FIG. 1 is a view showing a liquid crystal display device according to the related art. In FIG. 1, a liquid crystal display (LCD) device 10 includes a liquid crystal panel 20 displaying images, a backlight unit 30 supplying light to the liquid crystal panel 20, a control unit 40 supplying a control signal, a gate signal and a data signal to the liquid crystal panel 20, an inverter unit 50 adjusting power supplied to the backlight unit 30 and a system unit 60 controlling the control unit 40 and the inverter unit 50. The liquid crystal panel 20 includes a plurality of pixels to display images by using the gate signal and the data signal, and the backlight unit 30 includes an illuminating means to supply the light to the liquid crystal panel 20. The control unit 40 includes a timing controller formed on a printed circuit board (PCB). The control unit 40 generates and supplies a plurality of control signals and an RGB signal to the liquid crystal panel 20. The inverter unit 50 controls illumination of the backlight unit 30 and receives a dimming signal for adjusting illumination of the backlight unit 30 from the control unit 40 or the system unit 60. In addition, the system unit 60 includes an external interface circuit, such as a television system or a graphic card, to supply an image signal and a plurality of driving signals to the control unit 40 and supply the dimming signal to the inverter unit 50.

An LCD device displays images by re-aligning liquid crystal molecules of a liquid crystal layer. A time for re-aligning the liquid crystal molecules by an electric field may be defined as a response time of the LCD device. As the response time decreases, the liquid crystal molecules are re-aligned more rapidly and a property of the LCD device is improved. Recently, a moving picture response time (MPRT) defined as a response time recognized by human's eyes has been widely used as a standard for estimating a display capability of the LCD device. For example, when the LCD device has a relatively short MPRT, deterioration in display of the LCD device such as a motion blur may be improved.

The MPRT of the LCD device depends on a temperature. For example, as the temperature increases, the MPRT of the LCD device decreases. In addition, the MPRT of the LCD device is saturated over a critical temperature. For example, the critical temperature may be within a range of about 40° C. to about 60° C. Accordingly, the MPRT is optimized over the critical temperature.

Because a turned-off LCD device has a temperature lower than the critical temperature, an optimization time period is required for driving the LCD device with an optimized MPRT over the critical temperature after the LCD device is turned on. FIG. 2 is a graph showing a relation between a moving picture response time and a temperature in a liquid crystal display device according to the related art. In FIG. 2, a turned-off LCD device has a room temperature (RT) of about 20° C. and a first MPRT of MPRT 1. After the LCD device is turned on, as the LCD device is heated up by the backlight unit or the control unit, the temperature of the LCD device increases and the MPRT of the LCD device decreases. In addition, when the LCD device reaches the critical temperature Tc, the MPRT of the LCD device is saturated to a second MPRT of MPRT2. As a result, the LCD device displays images with a uniform MPRT.

Accordingly, during the optimization time period from the room temperature to the critical temperature Tc, the LCD device displays images with an unstable and relatively high MPRT and a display quality of the LCD device is deteriorated. Specifically, the moving image is not properly displayed by the LCD device during the optimization time period. For example, the optimization time period may be over about 1 hour, and the LCD device may display images of unsatisfactory display quality for a relatively long time.

SUMMARY OF THE INVENTION

Accordingly, the present invention is directed to a liquid crystal display device and a method of driving the same that substantially obviates one or more of the problems due to limitations and disadvantages of the related art.

An advantage of the present invention is to provide a liquid crystal display device where a time uniformity of a moving picture response time is improved by reducing an optimization time period from a room temperature to a critical temperature and a method of driving the liquid crystal display device.

Another advantage of the present invention is to provide a liquid crystal display device that is driven in one of a temperature-rising mode, where a luminance of a backlight unit increases and an image signal is converted to have a lower gray level, and a power-saving mode, where the luminance of the backlight unit decreases and the image signal is converted to have a higher gray level according to a real-time temperature measured by a temperature sensing means, and a method of driving the liquid crystal display device.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes: a liquid crystal panel; a temperature sensing means configured to measure a real-time temperature of the liquid crystal panel; a backlight unit configured to supply a light to the liquid crystal panel; a control unit configured to convert an image signal into an RGB signal and convert a first dimming signal to a second dimming signal according to the real-time temperature; and an inverter unit configured to adjust the backlight unit using the second dimming signal.

In another aspect of the present invention, a method of driving a liquid crystal display (LCD) device includes measuring a real-time temperature of the LCD device and inputting the real-time temperature to a control unit; comparing the measured real-time temperature and a pre-determined critical temperature over which a moving picture response time is saturated; converting an image signal into a RGB signal that is provided to a liquid crystal display panel and outputting a dimming signal to an inverter unit; analyzing gray levels of a frame of an image signal; displaying an image in the liquid crystal display panel using the RGB signal; and adjusting illumination of a backlight unit based upon the dimming signal input from the inverter unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the present invention, examples of which are illustrated in the accompanying drawings. Wherever possible, similar reference numbers will be used to refer to the same or similar parts.

Figure 1:
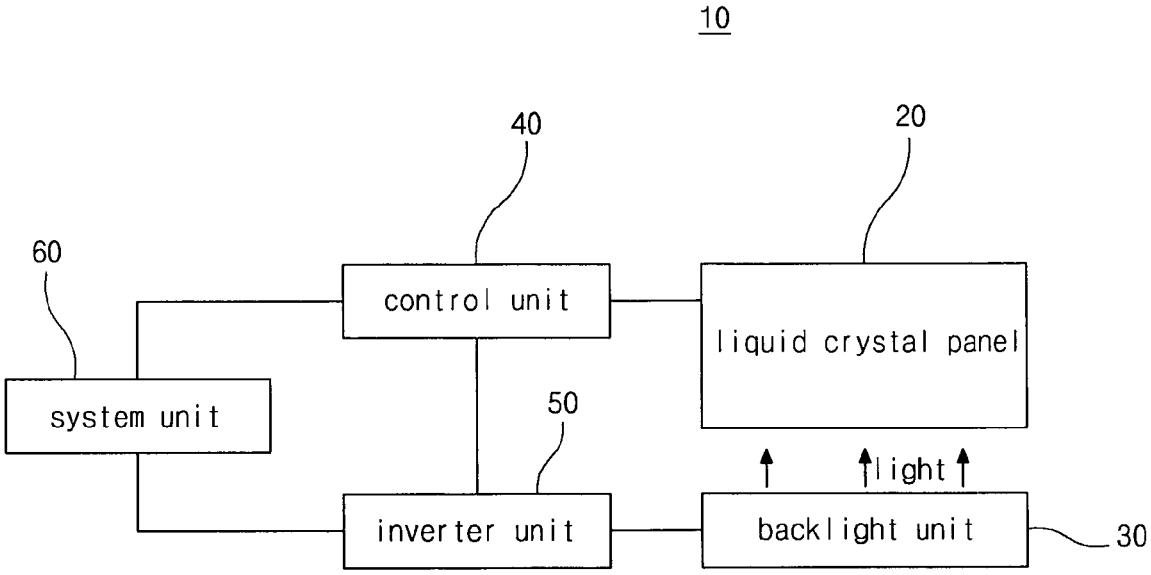
(related art) FIG. 1
FIG. 1 is a view showing a liquid crystal display device according to the related art.
Figure 2:
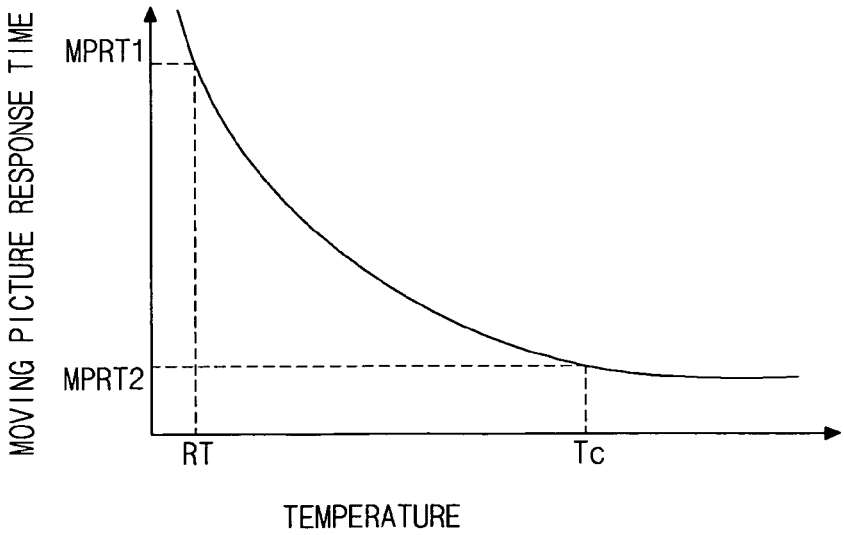
(related art) FIG. 2
FIG. 2 is a graph showing a relation between a moving picture response time and a temperature in a liquid crystal display device according to the related art.
Figure 3:
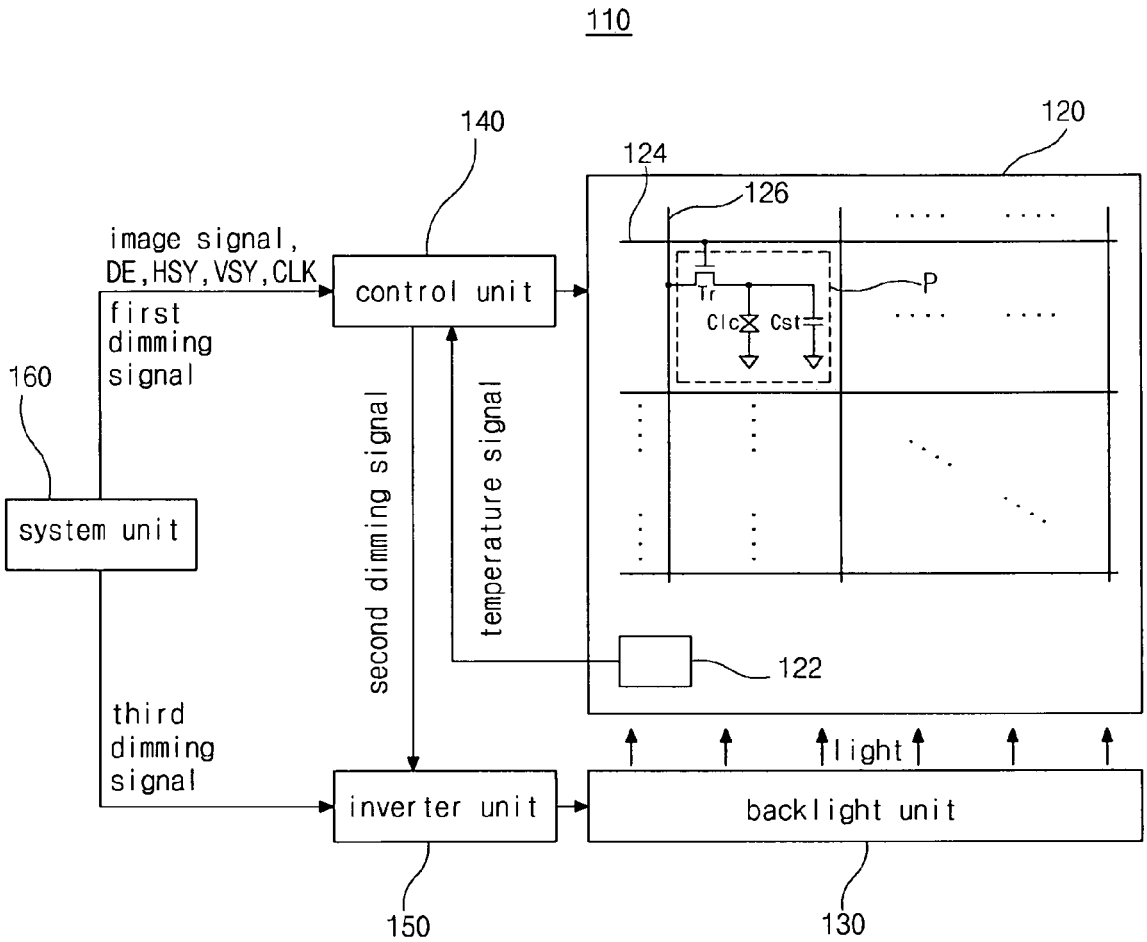
FIG. 3 is a view showing a liquid crystal display device according to an embodiment of the present invention.

FIG. 3 is a view showing a liquid crystal display device according to an embodiment of the present invention.

In FIG. 3, a liquid crystal display (LCD) device 110 includes a liquid crystal panel 120 displaying images, a temperature sensing means 122 measuring a temperature of the liquid crystal panel in real-time, a backlight unit 130 supplying light to the liquid crystal panel 120, a control unit 140 supplying a gate control signal, a data control signal and an RGB signal to the liquid crystal panel 120, an inverter unit 150 adjusting a power supplied to the backlight unit 130 and a system unit 160 controlling the control unit 140 and the inverter unit 150. The liquid crystal panel 120 includes first and second substrates (not shown) facing and spaced apart from each other and a liquid crystal layer (not shown) between the first and second substrates. A gate line 124 and a data line 126 cross each other to define a pixel region P that is formed on an inner surface of the first substrate. A thin film transistor (TFT) Tr is connected to the gate line 124 and the data line 126, and a liquid crystal capacitor Clc and a storage capacitor Cst are formed in the pixel region P.

Although not shown in FIG. 3, the liquid crystal panel 120 may include a gate driving integrated circuit (D-IC) generating a gate signal supplied to the gate line 124 and a data D-IC generating a data signal supplied to the data line 126. When the TFT Tr is turned on according to the gate signal, the data signal is supplied to the liquid crystal capacitor Clc and the storage capacitor Cst and the liquid crystal panel 120 displays images.

The backlight unit 130 includes an illuminating means to supply the light to the liquid crystal panel 120. For example, the illuminating means may include one of a cold cathode fluorescent lamp (CCFL), an external electrode fluorescent lamp (EEFL) and a light emitting diode (LED) lamp. The temperature sensing means 122 measures the real-time temperature of the liquid crystal panel 120 having the liquid crystal layer and outputs a temperature signal corresponding to the real-time temperature to the control unit 140. For example, the temperature sensing means 122 may include a thermally sensitive resistor (thermistor) where a resistance is changed according to a temperature. Although the temperature sensing means 122 is disposed on the liquid crystal panel 120 in FIG. 3, the temperature sensing means 122 may be disposed on one of the backlight unit 130, the control unit 140 and the inverter unit 150 in another embodiment.

The control unit 140 includes a timing controller formed on a printed circuit board (PCB). The control unit 140 generates the gate signal, the data signal and the RGB signal using the image signal, data enable signal DE, a horizontal synchronization signal HSY, a vertical synchronization signal VSY and a clock signal CLK from the system unit 160. In addition, the control unit 140 supplies the gate control signal to the gate D-IC of the liquid crystal panel 120 and supplies the data control signal and the RGB signal to the data D-IC of the liquid crystal panel 120. Specifically, the control unit 140 receives the temperature signal corresponding to the real-time temperature from the temperature sensing means 122 and recognizes the real-time temperature of the LCD device 110. To operate the LCD device 110 in one of a temperature-rising mode and a power-saving mode according to the real-time temperature, the control unit 140 converts the image signal into the RGB signal corresponding to a changed gray level and converts a first dimming signal from the system unit 160 into a second dimming signal corresponding to a changed duty ratio. The RGB signal is supplied to the liquid crystal panel 120 and the second dimming signal is supplied to the inverter unit 150.

The inverter unit 150 controls illumination of the backlight unit 130. Accordingly, the inverter unit 150 receives the second dimming signal from the control unit 140 and a third dimming signal from the system unit 160 for adjusting illumination of the backlight unit 130. In addition, the system unit 160 includes an external interface circuit, such as a television system or a graphic card, to supply the image signal, the data enable signal DE, the horizontal synchronization signal HSY, the vertical synchronization signal VSY, the clock signal CLK and the first dimming signal to the control unit 140 and supply the third dimming signal to the inverter unit 150.

The first, second and third dimming signals may be classified into A and B type voltages for controlling brightness (VBR). The A type dimming signal VBR-A is an analog direct current (DC) voltage signal and the B type dimming signal VBR-B is one of a pulse width modulation (PWM) signal and an analog DC voltage signal. In addition, although the first dimming signal is transmitted from the system unit 160 to the control unit 140 directly in FIG. 3, the first dimming signal may be transmitted from the system unit 160 to the control unit 140 via the inverter unit 150 (bypass) on the basis of a pin map of a connector in another embodiment.

Figure 4:
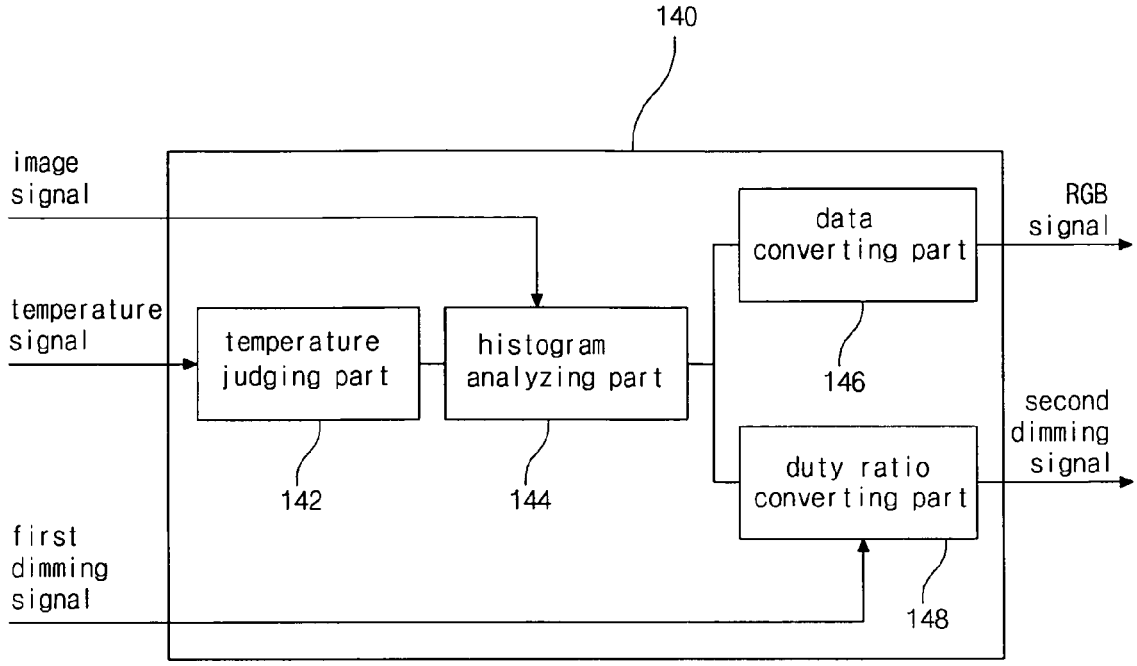
FIG. 4 is a view showing a control unit of a liquid crystal display device according to an embodiment of the present invention.

FIG. 4 is a view showing a control unit of a liquid crystal display device according to an embodiment of the present invention.

In FIG. 4, a control unit 140 of a liquid crystal display (LCD) device 110 (of FIG. 3) includes a temperature judging part 142, a histogram analyzing part 144, a data converting part 146 and a duty ratio converting part 148. The temperature judging part 142 interprets a temperature signal from a temperature sensing means 122 (of FIG. 3) and recognizes a real-time temperature of the LCD device 110. Further, the temperature judging part 142 determines an operation mode of the LCD device 110 by comparing the real-time temperature with a critical temperature where a moving picture response time (MPRT) is saturated. For example, when the real-time temperature is lower than the critical temperature, the temperature judging part 142 determines to operate the LCD device 110 in a temperature-rising mode, and the histogram analyzing part 144, the data converting part 146 and the duty ratio converting part 148 are driven in accordance with the temperature-rising mode. Further, when the real-time temperature is equal to or higher than the critical temperature, the temperature judging part 142 determines to operate the LCD device 110 in a power-saving mode and the histogram analyzing part 144, the data converting part 146 and the duty ratio converting part 148 are driven in accordance with the power-saving mode.

The histogram analyzing part 144 analyzes gray levels of an image signal from a system unit 160 (of FIG. 3) by a frame, and determines whether a data conversion and a duty ratio conversion for the image signal of the corresponding frame are performed or not. When the number of pixels having a gray level greater than or smaller than a predetermined reference gray level is equal to or greater than a predetermined reference number, the histogram analyzing part 144 determines that the data conversion and the duty ratio conversion are not performed. In addition, when the number of pixels having a gray level greater than or smaller than the predetermined reference gray level is smaller than the predetermined reference number, the histogram analyzing part 144 determines that the data conversion and the duty ratio conversion are performed.

For example, while the LCD device 110 is operated in the temperature-rising mode, the data converting part 146 decreases the gray level of the image signal to generate the RGB signal and the duty ratio converting part 148 increases the duty ratio of the first dimming signal to generate the second dimming signal. However, when the number of the pixels having a gray level equal to or lower than a first reference gray level in the image signal of a frame is equal to or greater than a first reference number, i.e., the LCD device 110 displays a relatively dark image, the data conversion may cause loss of too many pixels by saturation due to decrease of the gray level and the display quality of the LCD device 110 may be deteriorated. Accordingly, the histogram analyzing part 144 determines that the data conversion and the duty ratio conversion are not performed. Similarly, while the LCD device 110 is operated in the power-saving mode, the data converting part 146 increases the gray level of the image signal to generate the RGB signal and the duty ratio converting part 148 decreases the duty ratio of the first dimming signal to generate the second dimming signal. However, when the number of the pixels having a gray level equal to or higher than a second reference gray level in the image signal of the frame, i.e., the LCD device 110 displays a relatively bright image, the data conversion may cause loss of too many pixels by saturation due to increase of the gray level and the display quality of the LCD device 110 may be deteriorated. Accordingly, the histogram analyzing part 144 determines that the data conversion and the duty ratio conversion are not performed.

The data converting part 146 converts the image signal of the frame that is determined to be converted by the histogram analyzing part 144 into the RGB data having the changed gray level and the RGB signal is supplied to the liquid crystal panel 120 (of FIG. 3). For example, when the LCD device 110 is operated in the temperature-rising mode, the data converting part 146 may shift the image signal downwardly such that the gray level of the image signal decreases and the RGB signal having a decreased gray level lower than the gray level of the image signal is generated. In addition, when the LCD device 110 is operated in the power-saving mode, the data converting part 146 may shift the image signal upwardly such that the gray level of the image signal increases and the RGB signal having an increased gray level higher than the gray level of the image signal is generated.

The duty ratio converting part 148 converts the first dimming signal of the frame that is determined to be converted by the histogram analyzing part 144 into the second dimming signal having the changed duty ratio and the second dimming signal is supplied to the inverter unit 150 (of FIG. 3). For example, when the LCD device 110 is operated in the temperature-rising mode, the duty ratio converting part 148 may increase the duty ratio of the first dimming signal. Accordingly, the illumination time of the backlight unit 130 increases and the heat supplied to the liquid crystal panel 120 increases due to the second dimming signal having an increased duty ratio greater than the duty ratio of the first dimming signal. In addition, when the LCD device 110 is operated in the power-saving mode, the duty ratio converting part 148 may decrease the duty ratio of the first dimming signal. Accordingly, the illumination time of the backlight unit 130 decreases and the power consumption of the LCD device 110 decreases due to the second dimming signal having a decreased duty ratio smaller than the duty ratio of the first dimming signal.

As a result, when the real-time temperature of the LCD device 110 is lower than the critical temperature over which the MPRT is saturated and optimized, since the control unit 140 converts the image signal and the first dimming signal such that the gray level of the image signal decreases and the illumination time and the heat of the backlight unit 130 increase, the optimization time period for reaching the critical temperature is minimized. In addition, when the real-time temperature of the LCD device 110 is higher than the critical temperature, since the control unit 140 converts the image signal and the first dimming signal such that the gray level of the image signal increases and the illumination time and the heat of the backlight unit 130 decrease, the power consumption of the LCD device 110 is minimized.

Further, since the image is displayed by decrease of gray level and increase of duty ratio in the temperature-rising mode and by increase of gray level and decrease of duty ratio in the power-saving mode, the brightness of the image in one of the temperature-rising mode and the power-saving mode is substantially equal to the brightness of the image without conversion of the image signal and the duty ratio.

Figure 5A:
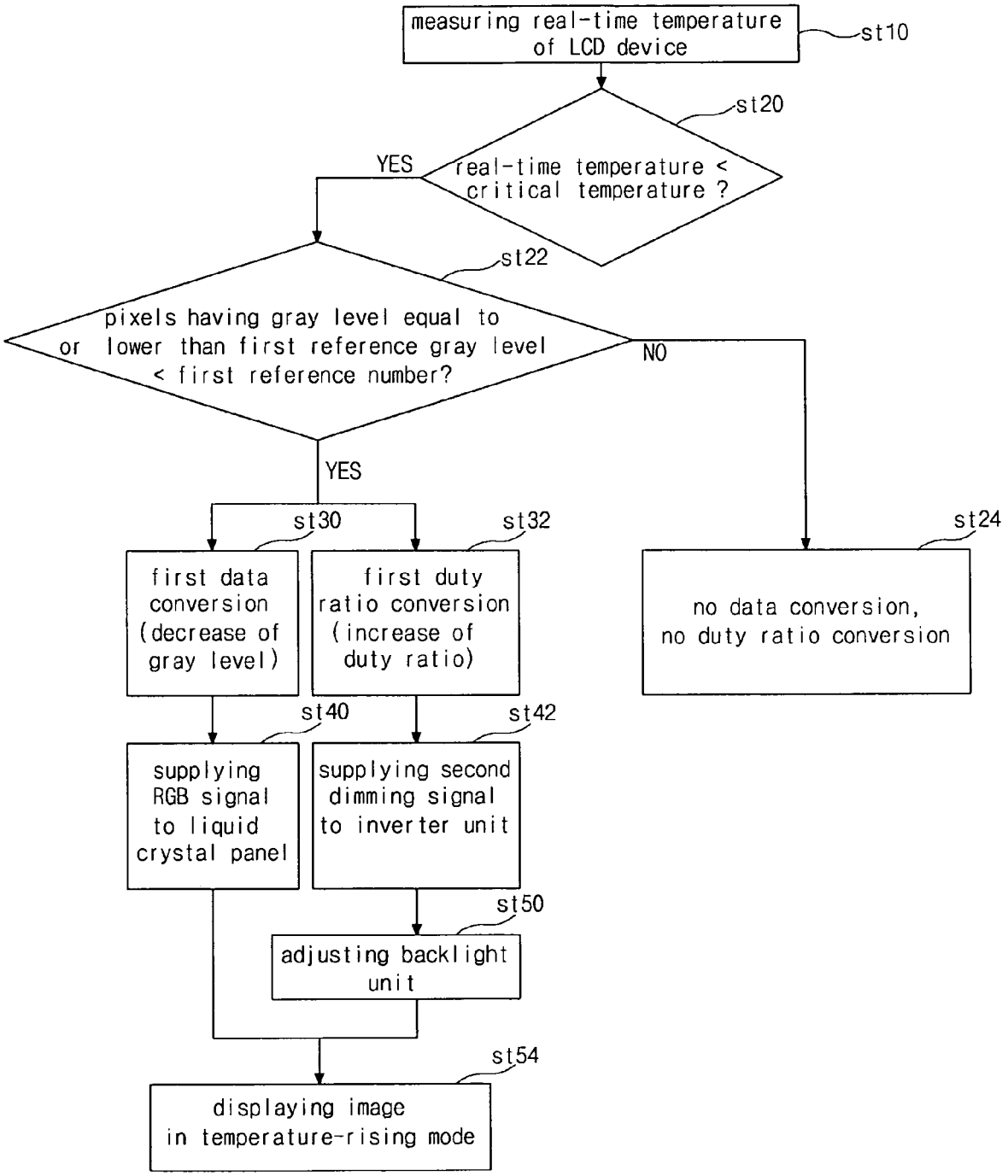
FIGS. 5A and 5B are flow charts showing a method of driving a liquid crystal display device according to an embodiment of the present invention.
Figure 5B:
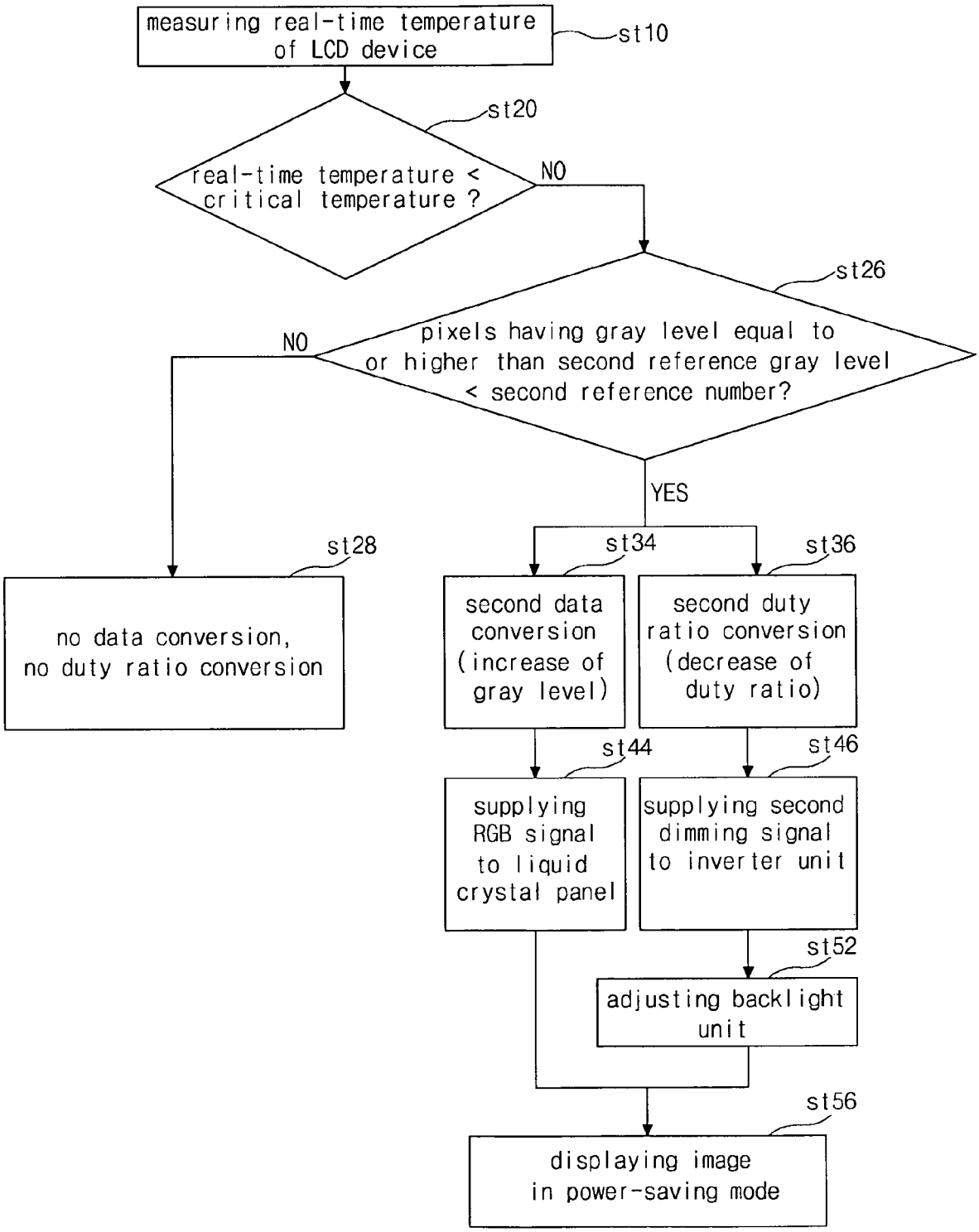

FIGS. 5A and 5B are flow charts showing a method of driving a liquid crystal display device according to an embodiment of the present invention.

In the step st10 of FIGS. 5A and 5B, the temperature sensing means 122 (of FIG. 3) measures a real-time temperature of a liquid crystal display (LCD) device 110 (of FIG. 3) and outputs a temperature signal corresponding to the real-time temperature to a control unit 140 (of FIG. 3). In the step st20, a temperature judging part 142 (of FIG. 4) of the control unit 140 compares the real-time temperature with a predetermined critical temperature over which a moving picture response time (MPRT) is saturated and optimized. Here, before or after the temperature judging part 142 compares the real-time temperature and the critical temperature, a histogram analyzing part 144 (of FIG. 4) of the control part 140 analyzes gray levels of an image signal by a frame and determines whether a data conversion and a duty ratio conversion are performed or not. More specifically, in step st22 of FIG. 5A, if the number of pixels having a gray level equal to or lower than a first reference gray level is equal to or greater than a first reference number, then, as illustrated in step st24, no data conversion or duty ratio conversion is performed. If the number of pixels having a gray level equal to or lower than a first reference gray level is less than a first reference number, then proceed to steps st30 and st32. On the other hand, in step st26 of FIG. 5B, if the number of pixels having a gray level equal to or higher than a second reference gray level is equal to or greater than a second reference number, then, as illustrated in step st28, no data conversion or duty ratio conversion is performed. If the number of pixels having a gray level equal to or higher than a second reference gray level is less than a second reference number, then proceed to steps st34 and st36.

Referring to FIG. 5A, in the steps st30 and st32, when the real-time temperature is lower than the critical temperature, a data converting part 146 (of FIG. 4) of the control unit 140 converts the image signal of the corresponding frame into an RGB signal such that a gray level of the image signal decreases (a first data conversion), and a duty ratio converting part 148 (of FIG. 4) of the control unit 140 converts a first dimming signal of the corresponding frame to a second dimming signal such that a duty ratio of the first dimming signal increases (a first duty ratio conversion). In the steps st40 and st42, the RGB signal generated by the first data conversion is supplied to a liquid crystal panel 120 (of FIG. 3), and the second dimming signal generated by the first duty ratio conversion is supplied to an inverter unit 150 (of FIG. 3). Further, in the step st50, the inverter unit 150 adjusts illumination of a backlight unit 130 (of FIG. 3) using the second dimming signal. In the step st54, the RGB signal having a decreased gray level as compared with the image signal of a system unit 160 (of FIG. 3) is applied to pixels of the liquid crystal panel 120 and the backlight unit 130 supplies light to the liquid crystal panel 120 according to the second dimming signal having an increased duty ratio as compared with the first dimming signal of the system unit 160. As a result, the LCD device 110 displays images in a temperature-rising mode.

In the temperature-rising mode, since the LCD device 110 is driven by using the increased duty ratio, the liquid crystal panel 120 is promptly heated up with more heat and the optimization time period for reaching the critical temperature is minimized.

Referring to FIG. 5B, in the steps st34 and st36, when the real-time temperature is higher than the critical temperature, the data converting part 146 of the control unit 140 converts the image signal of the corresponding frame into the RGB signal such that the gray level of the image signal increases (a second data conversion), and the duty ratio converting part 148 of the control unit 140 converts the first dimming signal of the corresponding frame into the second dimming signal such that the duty ratio of the first dimming signal decreases (a second duty ratio conversion). In the steps st44 and st46, the RGB signal generated by the second data conversion is supplied to the liquid crystal panel 120, and the second dimming signal generated by the second duty ratio conversion is supplied to the inverter unit 150. Further, in the step st52, the inverter unit 150 adjusts illumination of the backlight unit 130 using the second dimming signal. In the step st56, the RGB signal having an increased gray level as compared with the image signal of a system unit 160 is applied to the pixels of the liquid crystal panel 120 and the backlight unit 130 supplies light to the liquid crystal panel 120 according to the second dimming signal having a decreased duty ratio as compared with the first dimming signal of the system unit 160. As a result, the LCD device 110 displays images in a power-saving mode.

In the power-saving mode, since the LCD device 110 is driven by using the decreased duty ratio, the illumination time and the heat of the backlight unit 130 decrease and the power consumption of the LCD device 110 is minimized.

The data conversion and the duty ratio conversion in the temperature-rising mode and the power-saving mode will be illustrated hereinafter.

Figure 6A:
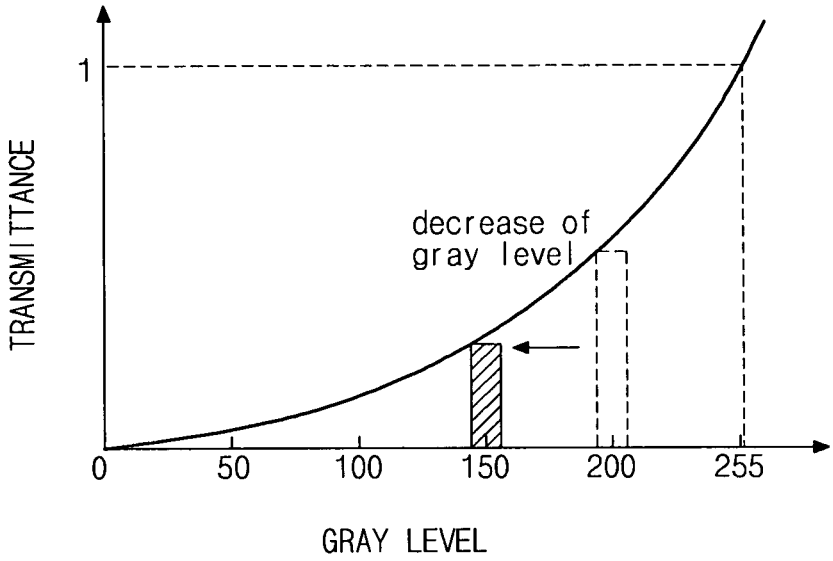
FIGS. 6A, 6B and 6C are graphs illustrating a decrease of gray level, a first data conversion and a first duty ratio conversion, respectively, in a temperature-rising mode of a liquid crystal display device according to an embodiment of the present invention.
Figure 6B:
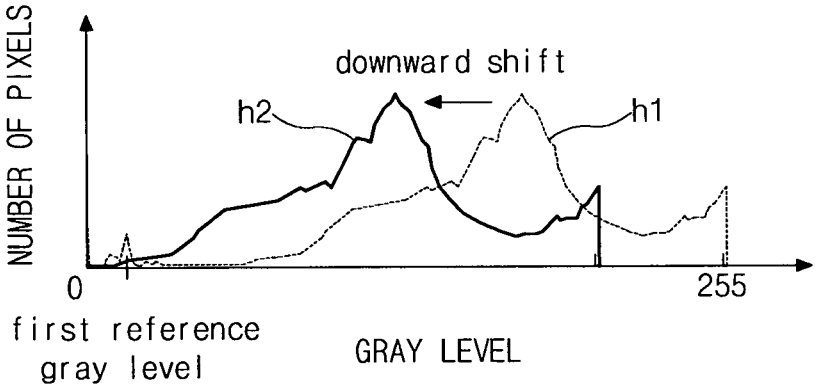
Figure 6C:
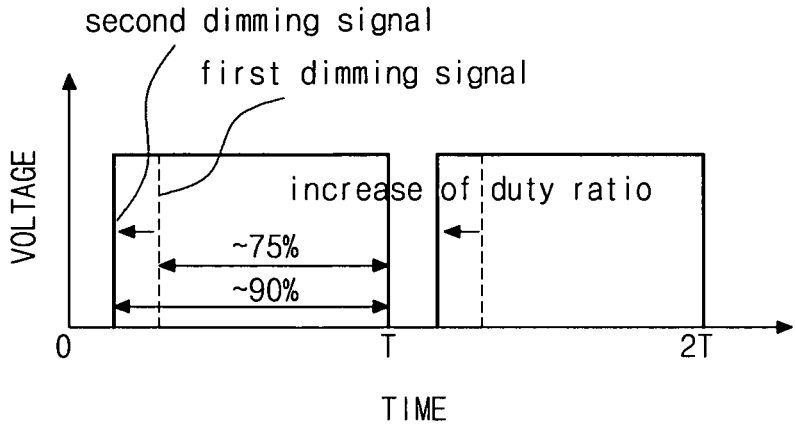
Figure 7A:
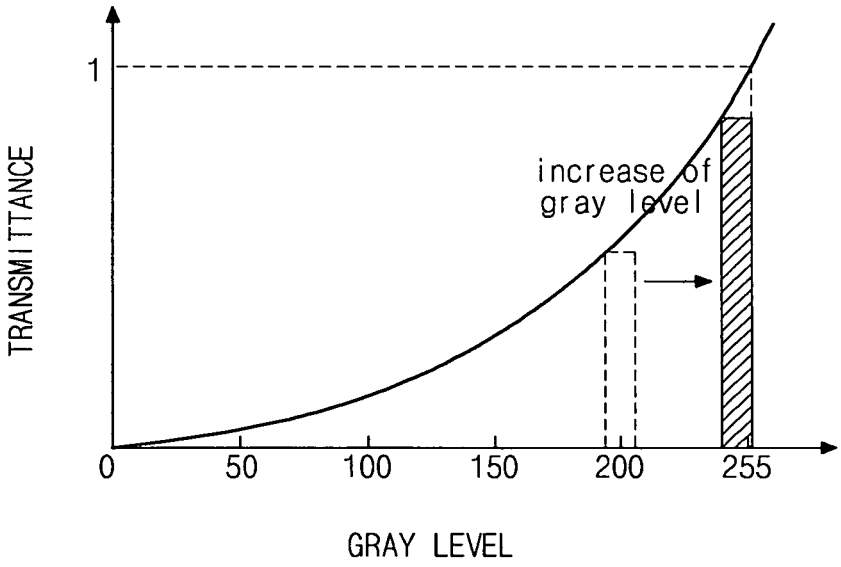
FIGS. 7A, 7B and 7C are graphs illustrating an increase of gray level, a second data conversion and a second duty ratio conversion, respectively, in a power-saving mode of a liquid crystal display device according to an embodiment of the present invention.
Figure 7B:
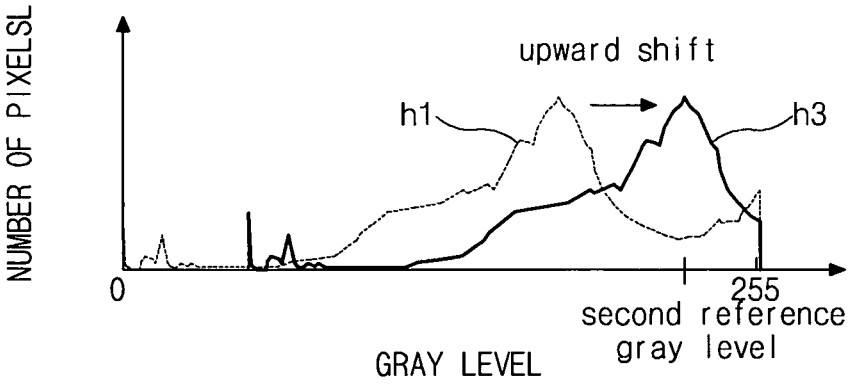
Figure 7C:
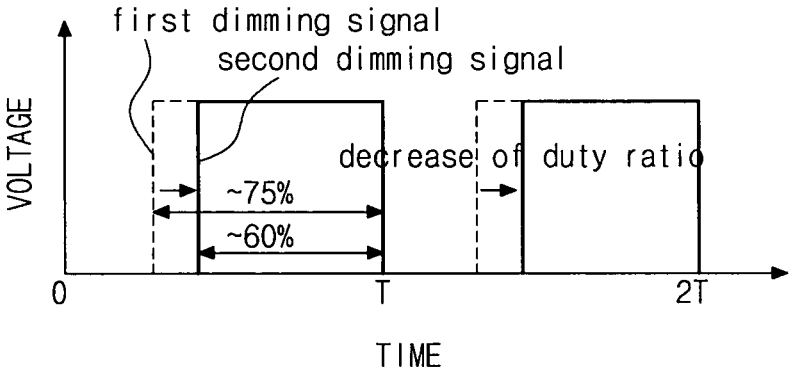

FIGS. 6A, 6B and 6C are graphs illustrating a decrease of gray level, a first data conversion and a first duty ratio conversion, respectively, in a temperature-rising mode of a liquid crystal display device according to an embodiment of the present invention, and FIGS. 7A, 7B and 7C are graphs illustrating an increase of gray level, a second data conversion and a second duty ratio conversion, respectively, in a power-saving mode of a liquid crystal display device according to an embodiment of the present invention.

In FIG. 6A, a gray level of an image signal of a system unit 160 (of FIG. 3) decreases in a temperature-rising mode of a liquid crystal display (LCD) device 110 (of FIG. 3). For example, a gray level of 200 may decrease to be a gray level of 150, and a transmittance of a liquid crystal panel 120 (of FIG. 3) may decrease according to the decrease of gray level, while a duty ratio of a first dimming signal of the system unit 160 increases. As a result, images displayed by the LCD device 110 in the temperature-rising mode have substantially the same brightness as images displayed by the LCD device 110 without data conversion and duty ratio conversion.

The data conversion is performed for the image signal of each frame and each pixel. The number of pixels having the corresponding gray level may be represented by a histogram. In FIG. 6B, a first histogram h1 corresponds to an image signal of a frame of the system unit 160 and a second histogram h2 corresponds to an RGB signal of the frame generated by a first data conversion. For example, the first data conversion may be performed by shifting downwardly gray levels of the first histogram h1 by a gray level of about 50.

The duty ratio conversion is performed for the first dimming signal of each frame. In FIG. 6C, for example, a first duty ratio conversion may be performed by increasing a duty ratio of about 75% of the first dimming signal of the system unit 160 to generate a second dimming signal having a duty ratio of about 90%.

Since gray levels equal to or lower than a first reference gray level becomes a gray level of 0 (saturation) by the first data conversion, the first data conversion for the gray levels equal to or lower than the first reference gray level may cause a data loss. Accordingly, when the number of pixels having a gray level equal to or lower than the first reference gray level is greater than a first reference number, i.e., the data loss deteriorates the display quality, the first data conversion and the first duty ratio conversion may not be performed.

In FIG. 7A, the gray level of the image signal of the system unit 160 increases in a power-saving mode of the LCD device 110. For example, a gray level of 200 may increase to be a gray level of 255, and the transmittance of the liquid crystal panel 120 may increase according to increase of gray level, while the duty ratio of the first dimming signal of the system unit 160 decreases. As a result, images displayed by the LCD device 110 in the power-saving mode have substantially the same brightness as images displayed by the LCD device 110 without data conversion and duty ratio conversion.

The data conversion is performed for the image signal of each frame and each pixel. In FIG. 7B, the first histogram h1 corresponds to the image signal of a frame of the system unit 160 and a third histogram h3 corresponds to the RGB signal of the frame generated by a second data conversion. For example, the second data conversion may be performed by shifting upwardly the gray levels of the first histogram h1 by a gray level of about 50.

The duty ratio conversion is performed for the first dimming signal of each frame. In FIG. 7C, for example, a second duty ratio conversion may be performed by decreasing the duty ratio of about 75% of the first dimming signal of the system unit 160 to generate the second dimming signal having a duty ratio of about 60%.

Since gray levels equal to or higher than a second reference gray level becomes a gray level of 255 (saturation) by the second data conversion, the second data conversion for the gray levels equal to or lower than the second reference gray level may cause the data loss. Accordingly, when the number of pixels having a gray level equal to or lower than the second reference gray level is greater than a second reference number, i.e., the data loss deteriorates the display quality, the second conversion and the second duty ratio conversion may not be performed.

Although the LCD device is operated in one of a temperature-rising mode and a power-saving mode each having a data conversion and a duty ratio conversion in FIGS. 3 and 4, the LCD device may be operated in one of a normal mode where the data conversion and the duty ratio conversion are not performed, a temperature-rising mode and a power-saving mode according to a user's selection in another embodiment. Further, although the LCD device is operated in the temperature-rising mode to minimize the optimization time period for reaching the critical temperature after the LCD device is turned on in FIGS. 3 and 4, the power-saving mode may be changed into the temperature-rising mode while the LCD device is being driven in another embodiment. For example, after a dark image is displayed by the LCD device for a relatively long time period or after the LCD device is driven in a relatively low temperature, the power-saving mode may be changed into the temperature-rising mode to improve the MPRT of the LCD device.

Consequently, a liquid crystal display device according to an embodiment of the present invention promptly reaches a critical temperature and an optimization time period for reaching the critical temperature is minimized. As a result, a time uniformity for a moving picture response time and a display quality are improved. In addition, a real-time temperature of the liquid crystal display device is measured by a temperature sensing means and the liquid crystal display device is operated in one selected from a temperature-rising mode and a power-saving mode according to the real-time temperature. Accordingly, a power consumption of the liquid crystal display device is decreased with an improvement in the time in uniformity for the moving picture response time.

It will be apparent to those skilled in the art that various modifications and variations can be made in the liquid crystal display device and the method of driving the liquid crystal display device of the present invention without departing from the spirit or scope of the invention. Thus, it is intended that the present invention cover the modifications and variations of this invention provided they come within the scope of the appended claims and their equivalents.

What is claimed is:

1. A liquid crystal display device (LCD), comprising:

a liquid crystal panel;

a temperature sensing means configured to measure a real-time temperature of the liquid crystal panel;

a backlight unit configured to supply a light to the liquid crystal panel;

a control unit configured to convert an image signal into an RGB signal according to the real-time temperature and convert a first dimming signal to a second dimming signal according to the real-time temperature; and an inverter unit configured to adjust the backlight unit using the second dimming signal, wherein when the real-time temperature is lower than a predetermined critical temperature, the control unit decreases a grey level of the image signal to generate the RGB signal and increases a duty ratio of the first dimming signal to generate the second dimming signal, and the inverter unit increases a luminance of the backlight unit according to the second dimming signal having an increased duty ratio as compared with the first dimming signal, and wherein when the real-time temperature is equal to or higher than a predetermined critical temperature, the control unit increases the grey level of the image signal to generate the RGB signal and decreases the duty ratio of the first dimming signal to generate the second dimming signal, and the inverter unit decreases the luminance of the backlight unit according to the second dimming signal having a decreased duty ratio as compared with the first dimming signal.

2. The liquid crystal display device of claim 1, further comprising a system unit configured to supply the first dimming signal and image signal to the control unit.

3. The liquid crystal display device of claim 2, wherein the system unit further supplies a third dimming signal to the inverter unit.

4. The liquid crystal display device of claim 3, wherein the liquid crystal panel is arranged to display an image using the RGB signal, and the inverter unit is configured to adjust power to the backlight unit using the second and third dimming signals.

5. The liquid crystal display device of claim 1, wherein the backlight unit includes one of a cold cathode fluorescent lamp (CCFL), an external electrode fluorescent lamp (EEFL), and a light emitting diode (LED) lamp.

6. The liquid crystal display device of claim 1, wherein the temperature sensing means is disposed on one of the liquid crystal panel, the backlight unit, the control unit and the inverter unit.

7. The liquid crystal display device of claim 2, wherein the control unit includes:

a temperature judging part configured to interpret the real-time temperature from the temperature sensing means;

a histogram analyzing part configured to analyze the gray level of the image signal from the system unit and to determine whether a data conversion and a duty ratio conversion for the image signal of a corresponding frame are performed;

a data converting part configured to convert the image signal into RGB data having a changed gray level that is supplied to the liquid crystal panel; and a duty ratio converting part configured to convert the first dimming signal into the second dimming signal supplied to the converter unit.

8. The liquid crystal display device of claim 7, wherein the histogram analyzing part is configured to determine whether a first data conversion and a first duty ratio conversion are performed when a number of pixels of the image signal of a frame having the gray level equal to or lower than a first reference gray level is less than a first reference number, and to determine whether a second data conversion and a second duty ratio conversion are performed when a number of the pixels of the image signal of the frame having the gray level equal to or higher than a second reference gray level is less than a second reference number.

9. The liquid crystal display device of claim 7, wherein the temperature judging part determines an operation mode of the liquid crystal display device based upon a comparison of the real-time temperature from the temperature sensing means with the -pre-determined critical temperature.

10. The liquid crystal display device of claim 9, wherein the operation mode is one of a temperature-rising mode when the real-time temperature is lower than the pre-determined critical temperature, and a power-saving mode when the real-time temperature is equal to or higher than the pre-determined critical temperature.

11. The liquid crystal display device of claim 10, wherein in the temperature-rising mode, the duty ratio converting part increases the duty ratio of the first dimming signal, and in the power-saving mode, the duty ratio converting part decreases the duty ratio of the first dimming signal.

12. The liquid crystal display device of claim 1, wherein the temperature sensing means includes a thermally sensitive resistor (thermistor).

13. A method of driving a liquid crystal display (LCD) device, comprising:

measuring a real-time temperature of the LCD device and inputting the real-time temperature to a control unit;

comparing the measured real-time temperature and a pre-determined critical temperature over which a moving picture response time is saturated;

converting an image signal to a RGB signal that is provided to a liquid crystal display panel according to the measured real-time temperature and converting a first dimming signal to a second dimming signal according to the measured real-time temperature to output the second dimming signal to an inverter unit;

analyzing a gray level of a frame of the image signal;

displaying an image in the liquid crystal display panel using the RGB signal; and adjusting illumination of a backlight unit based upon the second dimming signal input from the inverter unit, wherein when the real-time temperature is lower than a predetermined critical temperature, the control unit decreases a grey level of the image signal to generate the RGB signal and increases a duty ratio of the first dimming signal to generate the second dimming signal, and the inverter unit increases a luminance of the backlight unit according to the second dimming signal having an increased duty ratio as compared with the first dimming signal, and wherein when the real-time temperature is equal to or higher than a predetermined critical temperature, the control unit increases the grey level of the image signal to generate the RGB signal and decreases the duty ratio of the first dimming signal to generate the second dimming signal, and the inverter unit decreases the luminance of the backlight unit according to the second dimming signal having a decreased duty ratio as compared with the first dimming signal.

14. The method of claim 13, further comprising: supplying an additional dimming signal to the inverter unit.

15. The method of claim 13, further comprising:

performing at least one of a data conversion and a duty ratio conversion.

16. The method of claim 13, further comprising displaying images in a temperature-rising mode when the compared real-time temperature is lower than the pre-determined critical temperature and a number of pixels of the image signal of a frame having the gray level equal to or lower than a first reference gray level is smaller than a first reference number, wherein displaying images in the temperature-rising mode includes:

performing a first data conversion of converting the image signal to the RGB signal, wherein the RGB signal has a decreased gray level in comparison to the image signal of a system unit;

performing a first duty ratio conversion of converting the first dimming signal of a corresponding frame to the second dimming signal, wherein the duty ratio of the second dimming signal increases in comparison with the duty ratio of the dimming signal of the system unit;

supplying the RGB signal generated by the first data conversion to the liquid crystal display panel; and supplying the second dimming signal generated by the first duty ratio conversion to the inverter unit.

17. The method of claim 13, further comprising displaying images in a power-saving mode when the compared real-time temperature is equal to or higher than the pre-determined critical temperature and a number of pixels of the image signal of a frame having the gray level equal to or higher than a first reference gray level is smaller than a first reference number, wherein displaying images in the power-saving mode includes:

performing a second data conversion of converting the image signal to the RGB signal, wherein the RGB signal has an increased gray level in comparison to the image signal of a system unit;

performing a second duty ratio conversion of converting the first dimming signal of a corresponding frame to the second dimming signal, wherein the duty ratio of the second dimming signal decreases in comparison with the duty ratio of the first dimming signal of the system unit;

supplying the RGB signal generated by the second data conversion to the liquid crystal display panel; and supplying the second dimming signal generated by the second duty ratio conversion to an inverter unit.

18. The method of claim 16, wherein the first data conversion is performed for the image signal of each frame and each pixel.

19. The method of claim 17, wherein the second data conversion is performed for the image signal of each frame and each pixel.

20. The method of claim 16, wherein the first duty ratio conversion is performed for the first dimming signal of each frame.

21. The method of claim 17, wherein the second duty ratio conversion is performed for the first dimming signal of each frame.

22. The liquid crystal display device of claim 1, wherein the RGB signal converted by the control unit has one of a first gray level downwardly shifted and a second gray level upwardly shifted from the gray level of the image signal.

23. The method of claim 13, wherein converting the image signal to the RGB signal includes one of downwardly shifting and upwardly shifting the gray level of the image signal.

* * * * *